US005525010A

United States Patent [19]

Kenny et al.

[11] Patent Number: 5,525,010

[45] Date of Patent: Jun. 11, 1996

[54] METHOD AND APPARATUS FOR SEVERING TUBULAR MEMBERS

[75] Inventors: John J. Kenny, Marrero, La.; David L. Siggers, Camden, Ark.

[73] Assignee: Senior Power Services, Inc., Demex Division, Lyman, S.C.

[21] Appl. No.: 243,814

[22] Filed: May 17, 1994

[51] Int. Cl.[6] ..... E02D 9/04

[52] U.S. Cl. ..... 405/195.1; 102/313; 166/55; 166/361; 405/228; 405/232

[58] Field of Search ..... 405/195.1, 224, 405/227, 228, 232, 237; 166/55, 350, 361, 241.1, 241.6, 259, 174; 52/155, 160; 102/312, 313, 319, 324

[56] References Cited

U.S. PATENT DOCUMENTS

| | | | |
|---|---|---|---|
| 4,015,433 | 4/1977 | Shibata | 52/160 X |
| 4,528,910 | 7/1985 | Blanc et al. | 166/36 |
| 4,768,899 | 9/1988 | Dysarz | 166/55 X |
| 4,787,315 | 11/1988 | Kenny | 102/313 |
| 4,808,037 | 2/1989 | Wade et al. | 166/55 X |
| 4,909,320 | 3/1990 | Hebert et al. | 166/361 X |
| 5,177,321 | 1/1993 | Kenny | 166/55 X |
| 5,238,063 | 8/1993 | Hebert | 166/55 X |
| 5,360,292 | 11/1994 | Allen et al. | 405/228 X |

*Primary Examiner* Dennis L. Taylor
*Attorney, Agent, or Firm* Keaty & Keaty

[57] ABSTRACT

A method and apparatus for severing tubular members below a mud line. The mud is evacuated from the target area of the tubular member and the apparatus is lowered through the inner opening of the tubular member to the target area. A housing of the apparatus carries a plurality of centralizing fins which hinge 90 degrees in relation to their pre-deployed position and centralize the housing in the target area. An explosive material contained in the housing is extruded, by movement of the piston, into a flexible bag secured at a lower portion of the housing, forcing the bag to form a receptacle for the explosive. A sidewall of the bag protector pivots at a right angle to form a support for the receptacle with the explosive.

33 Claims, 3 Drawing Sheets

METHOD AND APPARATUS FOR SEVERING TUBULAR MEMBERS

BACKGROUND OF THE INVENTION

This invention relates to a method and apparatus for severing tublar members at sub-sea locations, and more particularly for severing piling, which supports offshore structures, below a mud line.

Current environmental regulations require that removal of offshore structures be accomplished in such a manner that no pipes, tubing, or pilings extend above the mud line after the structure has been removed. The sea bed must be returned to its original condition to avoid field navigational hazards in the area where an offshore structure has been positioned. Additional consideration should be given to the marine life whose conditions might be adversely affected if any such pipes remain extended from the sea bed. To this end, various sub-sea explosive devices have been provided, some of which utilize diver delivered charges, and some of which are designed to deliver a detonating device into the well pipe. However, these devices are rather complex, have difficulty of severing tubular members below the mud line and often are not suitable to handle the tasks demanded by the modern regulations.

The present invention contemplates elimination of drawbacks associated with the prior art and provision of a method and apparatus for severing a tubular member below a mud line.

SUMMARY OF THE INVENTION

It is, therefore, an object of the present invention to provide a method and an apparatus for severing tubular members in a sub-sea location.

It is another object of the present invention to provide an apparatus for delivering a detonating charge below a mud line.

It is a further object of the present invention to provide a means for centering a detonating charge inside a tubular member.

It is still a further an object of the present invention to provide a method of forming a shaped charge at the location, wherein the tubular member is to be severed.

It is still a further object of the present invention to provide an apparatus for forming a shaped charge which is easy to use and inexpensive to manufacture.

These and other objects of the present invention are achieved through a provision of an apparatus for severing tubular members which comprises a generally cylindrical housing provided with a plurality of centralizing fins hingedly attached to the housing. The fins extend in a generally parallel relationship to the longitudinal axis of the housing when the apparatus is being lowered to the target area, and hinge into a substantially perpendicular position to the longitudinal axis of the housing when the apparatus is deployed, thereby centralizing position of the housing within the target area of the explosion.

The housing is adapted to retain an extrudable explosive material between a slidably movable piston and an extrusion head. The extrusion head is formed with a rupturable disk allowing a forceful evacuation of the explosive material from the housing into a collapsible flexible bag secured to the extrusion head and extending below the housing. Once the explosive material is delivered into the bag, it forms a shaped, or bulk charge receptacle for the explosive material which can sever the tubular member in a generally clean, even cut.

A flexible cord is spirally folded on top of the piston, the cord being a part of a charge initiation system. The area around the primacord receives a pressurized fluid which serves as a downward force on the piston. The extrusion piston is allowed to move, a discrete distance, within the housing under an expansion force of a spring and force a bag protector, or enclosure, surrounding the bag downwardly to some distance. Once the side wall of the bag protector moves below the bottom of the housing, the side wall is allowed to pivot outwardly, to substantially perpendicular relationship to its pre-deployed position and form a support surface to the expanded bag which received the explosive material.

The method in accordance with the present invention contemplates evacuation of the mud from the target area in the tubular member, deployment of the apparatus within the target area and delivery of a detonating signal to the explosive material to thereby cause severing of the tubular member.

BRIEF DESCRIPTION OF THE DRAWINGS

Reference will now be made to the drawings wherein like parts are designated by like numerals, and wherein.

DETAIL DESCRIPTION OF THE PREFERRED EMBODIMENT

Figure 1:
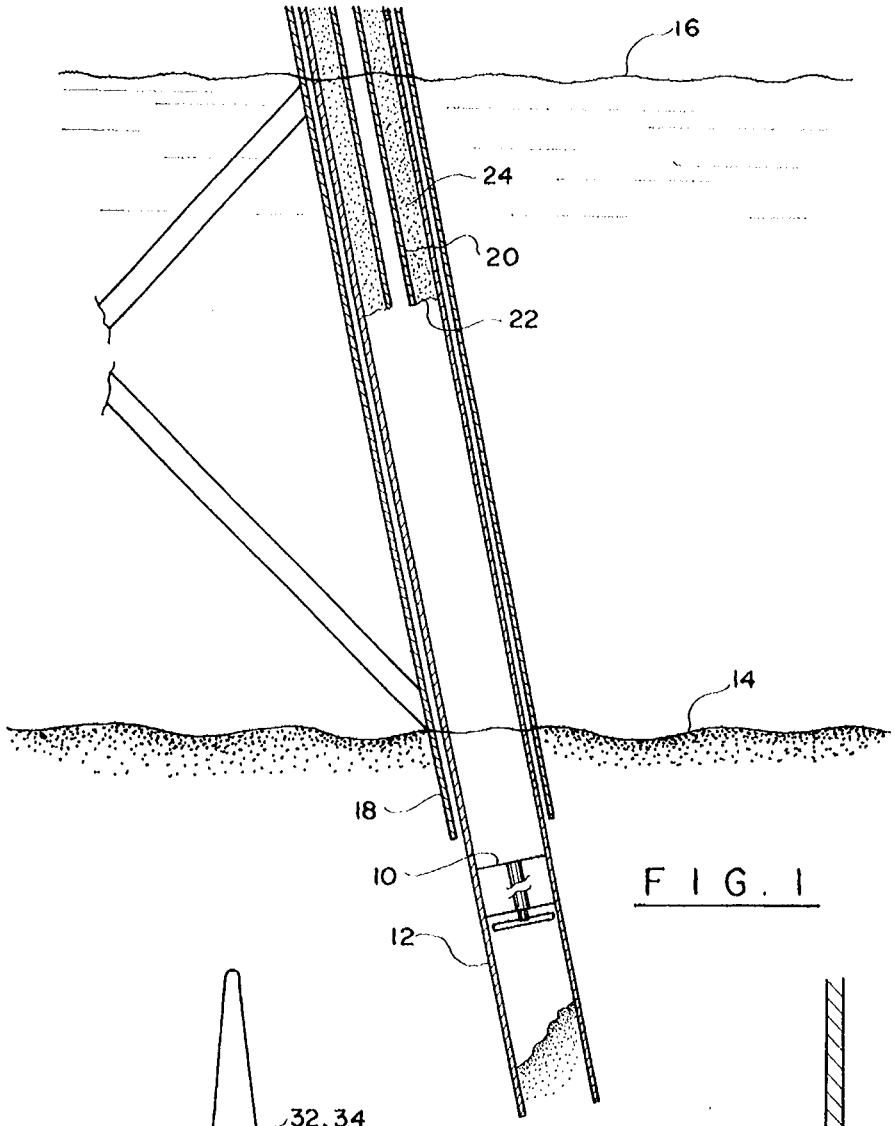
FIG. 1 is a schematic view illustrating location of the apparatus in accordance with the present invention in relation to a sub-sea piling.

Referring now to the drawings in more detail, numeral 10 designates a detonating device in accordance with the present invention. The device 10 is adapted for positioning within a piling 12 below a mud line 14. The piling 12 supports a structure (not shown) above a water line 16 during the offshore structure's operation. A jacket leg 18 is circumferentially positioned around the piling 12 and extends at least some distance below the mud line 14 in its lower portion and above the water line 16 at its upper portion. Mounted within a piling 12 is a narrow pipe 20 which conventionally extends from above the water line 16 to some distance, such as at 22, below the water line 16 at its lower end. An annulus 24, formed between the interior wall of the piling 12 and the exterior surface of the pipe 20, is filled with grout or cement, so as to fixedly secure the pipe 20 within the piling.

While the offshore structure is in place, that portion of the piling which is buried in the sea bed is filled with mud below the mud line 14. Since it is necessary to sever the piling 12 below the mud line 14, at least a portion of the mud must be evacuated from the piling 12 to allow positioning of the detonating device in the target area below the mud line 14. For this purpose, the present invention contemplates evacuation, or jetting of the mud through the use of conventional mud pumps (not shown) from the target area to the surface. Once the evacuation of the area has been completed, the detonation device can be lowered through the narrow inner pipe 20 to the sub-sea level in the target area and deployed therein in a manner schematically shown in FIG. 2.

Figure 2:
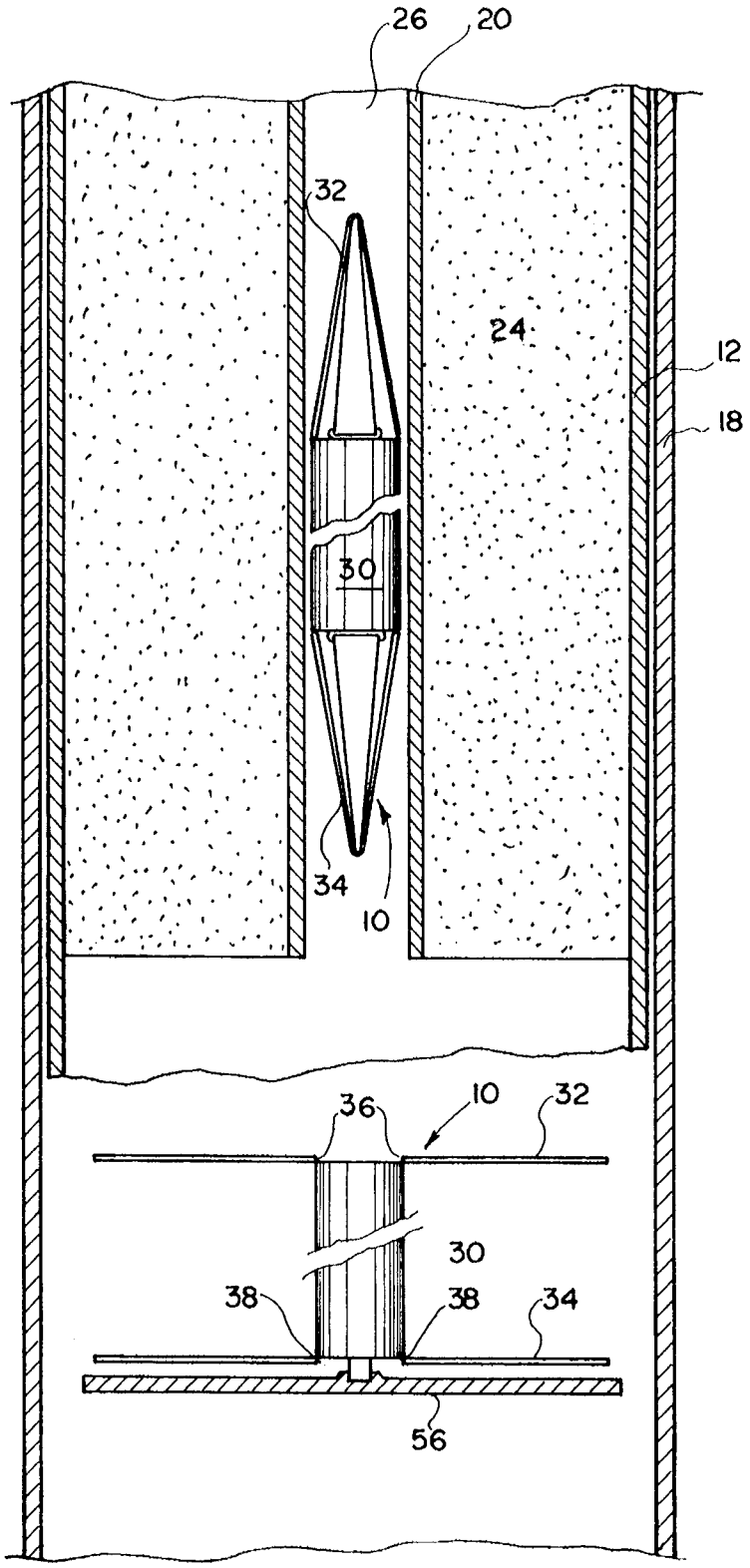
FIG. 2 is a schematic view illustrating movement of the apparatus in accordance with the present invention through an internal pipe within the piling and a schematic view of the apparatus deployed in the target area.

The detonating device comprises an elongated housing 30 having a plurality of centering fins 32 secured at its upper end and a plurality of centering fins 34 secured at its lower end. The fins 32 and 34 are hingedly attached to the elongated housing 30 which allows the fins to move from a position in general co-alignment with a vertical axis of the housing 30 to a position substantially perpendicular to that axis. As can be seen in FIG. 2, the fins 32 and 34 are oriented upwardly and downwardly, respectively, while the device 10 is lowered through an opening 26 of the pipe 20. In this manner, it becomes possible to move the device through a narrow conduit without the necessity of removing the pipe 20 and the surrounding cement from the piling 12.

Once deployed in the target area, at the level wherein the detonation is to take place, the housing 30 becomes oriented vertically (as shown in the lower part of FIG. 2), and the fins 32 and 34 move outwardly, extending perpendicularly to the longitudinal axis of the housing 30. The fins 32 and 34 are allowed to rotate 90 degrees, so as to position the housing 30 at about the center of the piling 12. Stop means (not shown) prevent the fins 32 and 34 from rotating more than 90 degrees at their respective hinged attachments 36 and 38.

Figure 3:
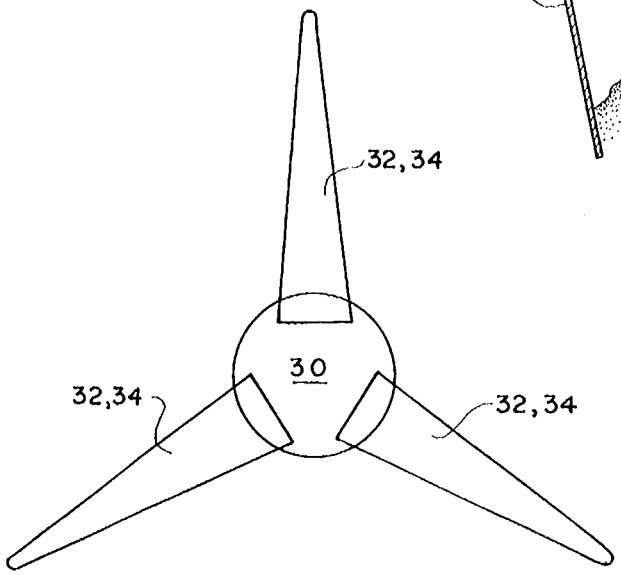
FIG. 3 is a schematic aft view of the apparatus of the present invention illustrating centering fins in a deployed condition.

As shown in FIG. 3, the number of fins 32, 34 can be three or more in number, the fins can be circumferentially equidistantly spaced about the circumference of the housing 30 and are adapted to prevent a detonation device 10 from moving away, to any substantial degree, from the center of the piling 12 when the apparatus 10 is in a deployed position.

Figure 4:
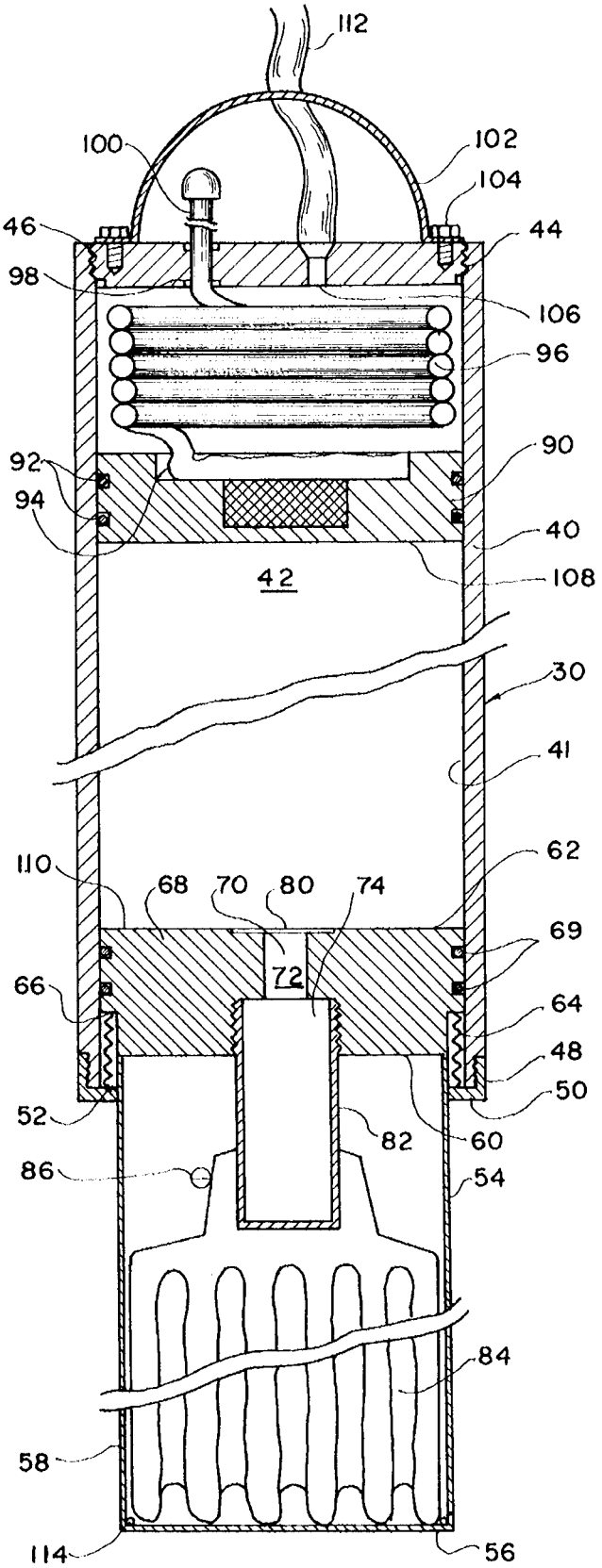
FIG. 4 is a detail cross-sectional view of the charge device shown without centering fins.

Turning now to FIG. 4, the housing 30 is shown to comprise a cylindrically-shaped enclosure wall 40 having a central opening 42 extending therethrough. The upper part of the wall 40 is provided with internal threads 44 which are adapted for engagement with a top plate 46 having matching external threads extending about its outer circumference. The bottom portion of the wall 40 is externally threaded so as to threadably engage a bottom plate 48 which has a generally L-shaped cross section and extends inwardly, towards the center of the opening 42 at its horizontal part 50.

The part 50, as can be seen in drawing, has greater length of the thickness than the wall 40, forming a shoulder 52 on its inner surface. The horizontally extending part 50 contacts the exterior walls of a bag protector 54. The bag protector 54 is formed by a bottom wall 56 and hingedly attached wall(s) 58. The wall(s) 58 extend to a distance inside the opening 42 and contact, at its uppermost end, the lowermost portion 60 of an extrusion head 62.

The external diameter of the bottom or lowermost portion 60 of the extrusion head, 62 is slightly smaller than the internal diameter of the opening 42. A resilient compression means, such as spring 64, is mounted in the annular space between the inner surface 41 of the wall 40 and the exterior surface of the bottom portion 60. The spring 64 abuts the inner surface 52 of the part 50, and a downwardly facing shoulder 66 of an upper part 68 of the extrusion head 62. One or two O-rings 69 are positioned within specially provided grooves to seal the area between the inner surface 41 and the extrusion head 62.

The extrusion head 62 is provided with a central opening 70 which has a reduced diameter part 72 and an enlarged diameter part 74. A rupturable disk 80 covers the top of the opening 70, thereby closing the opening during deployment of the apparatus 10 into the target area. The portion of the extrusion head 62 which defines the opening 74 is formed with threads adapted for engagement with matching threads of a bag carrier 82. The bag carrier 82 extends downwardly from the bottom portion 60 within the bag protector 54. A collapsible flexible bag 84 is securely attached to the bag carrier 82 and, in its collapsed state, fits within the space defined by the walls 56 and 58 of the bag protector 54. A suitable hose clamp insures secure attachment of the bag 84 to the bag carrier 82.

Mounted in the upper portion of the housing 30 is an extruder piston 90 which frictionally engages the inner circumference of the housing 30. Suitable 0-rings 92 insure a sealed engagement of the piston 90 with a wall 41. The extruder piston 90 is formed with an upwardly facing groove 94 which is designed to accommodate at least a part of a flexible collapsible conduit, or primacord 96. The remainder portion of the cord 96 fits within the housing 30 above the extruder piston 90 and is folded in a spiral manner. The second, free end 100 of the cord extends outwardly from the housing 30 through a suitable opening 98 formed in the top plate 46. This end of the conduit 96 is designed to be connected to a suitable charge transmitting means (not shown). A supply of fluid, for example water, or air, which will provide a downward pressure on the piston 90, as will be described below hereinafter is admitted into the area around the primacord through an opening 106. A strong handle 102 is secured, such as by bolts 104 to the top plate 46 to allow lowering of the device 10 to a subsurface location.

The opening 106 formed a distance from the opening 98 allows connection of fluid conduits, such as for example conduit 112, into the area around the primacord 96.

An extrudable explosive material (not shown) is positioned within the opening 42, between the bottom surface 108 of the extruder piston 90 and the top surface 110 of the extrusion head 62.

In operation, once the device 10 has been deployed in the target area and the centering fins 32 and 34 have been extended to centralize the position of the device 10, water, gas or other fluid is supplied into the conduit 112, exerting a downward force on the extruder piston 90. The extrudable explosive causes the disk 80 to rupture and allows the explosive to move through the opening 70 into the bag carrier 82 and then into the bag 84.

At the same time, the extrusion head 62 moves downward, compressing the spring 64, to some degree, forcing the uppermost end of the bag protector walls 58 to move downward and below the part 50 of the bottom plate 48. The wall 58 hinges, such as at 114, allowing the wall to rotate about 90 degrees angle in relation to the original position, such that the wall 58 moves to approximately the same horizontal level as the bottom plate 56, supporting the bottom of bag 84.

After the bag 84 has been filled with an explosive, it accepts a generally circular configuration, shown schematically in FIG. 2. The outside surface of the bag 84 is positioned at about the same distance from the inner wall of the piling 12, such that the charge is centered within the piling. Once the device 10 has been operationally deployed in the target area, a detonating signal is delivered from the surface to the primacord 96 and then to the explosive material within the bag 84, causing rupture of the bag and severing the piling 12 simultaneously about its entire circumference.

Figure 5:
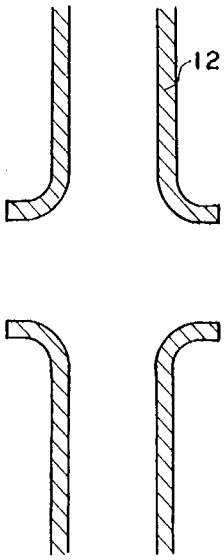
FIG. 5 is a schematic view illustrating the manner in which detonating force acts on the tubular member.

The charge contained within the bag 84 allows to sever the tubular member in a manner schematically illustrated in FIG. 5, causing little damage to the severed ends and providing a "clean cut" of the pipe. The liberated piling 12 can then be moved, along with the offshore structure, to any desired new location, while the remaining severed bottom of the piling 12 remains well below the mud line 14.

The bag protector 54 can be glued to the bag 84 to protect the bag during installation and pumping procedure. The bag protector can be made from PVC pipe or a small diameter light metal tubing, if desired. The fins 32 and 34 can be provided with spring loaded hinges to allow extension of the centralizing fins in the deployment area. The fins themselves can be made from rods, plates, or other lightweight material which can be secured together to form a generally triangular-shaped fins, allowing the device 10 to be moved through a narrow opening 26 without contacting the walls of the pipe 20 and blocking the opening 26.

Although not shown, the electrical cables and the lowering cable can be attached to the handle 102 and the housing 30 in a manner well within the knowledge of those skilled in the art. The compressive fluid admitted into the housing 30 can be substituted by other compression means, for example spring, for applying a compression force on the piston 90 and moving the piston 90 downwardly. Many changes and modifications can be made within the design of the present invention without departing from the spirit thereof. I, therefore, pray that my rights to the present invention be limited only by the scope of the appended claims.

I claim:

1. An apparatus for severing tubular members, comprising:

a generally cylindrical housing having a central opening extending through substantially entire length of the housing;

a piston means adapted for axial sliding movement within said central opening;

a means for centralizing position of the housing within the tubular member; and an explosive means carried by said housing for explosively severing the tubular member in a target area.

2. The apparatus of claim 1, further comprising a means for limiting downward movement of the piston means.

3. The apparatus of claim 2, wherein said limiting means comprises an extrusion head mounted in a lower part of the central opening.

4. The apparatus of claim 2, further comprising a collapsible means for receiving an explosive material, said collapsible means being secured to said limiting means.

5. The apparatus of claim 4, further comprising means for applying a downward force on said piston means to thereby extrude explosive material contained in said housing into the explosive receiving means.

6. The apparatus of claim 2, wherein said limiting means comprises an upper portion which sealingly engages an interior wall of the housing and a reduced diameter lower portion which defines an annular space between its exterior surface and the interior wall of the housing.

7. The apparatus of claim 6, wherein a compressible spring means is mounted in said annular space to allow said limiting means to move a discrete distance downwardly.

8. The apparatus of claim 7, further comprising a collapsible flexible means for receiving an explosive material secured to the lower portion of the limiting means.

9. The apparatus of claim 8, wherein said means for receiving an explosive material comprises a flexible bag which has a diameter smaller than said central opening when said bag is in an expanded condition.

10. The apparatus of claim 8, further comprising a means for protecting the explosive material receiving means.

11. The apparatus of claim 10, wherein said protecting means comprises a generally cylindrical enclosure having an upper end which contacts said lower portion of the limiting means, such that any downward movement of the limiting means forces the enclosure downward, away from said housing.

12. The apparatus of claim 11, wherein said enclosure comprises a side wall hingedly moveable between a first position, in a substantially parallel relationship to a longitudinal axis of the housing, and a second position, substantially perpendicular to said longitudinal axis.

13. The apparatus of claim 12, wherein said side wall forms at least a part of a support for said means for receiving the explosive material when said side wall is in its second position.

14. The apparatus of claim 8, wherein said means for receiving the explosive material comprises a flexible bag which forms a receptacle for the explosive material extruded into the bag.

15. The apparatus of claim 1, further comprising means for applying a downward force on the piston means.

16. The apparatus of claim 15, wherein said means for applying the downward force comprises a pressurized fluid which is admitted into said housing above said piston means.

17. The apparatus of claim 1, wherein said centralizing means comprises a plurality of fins hingedly attached to said housing and extending in a substantially parallel relationship to a longitudinal axis of the housing while the apparatus is being lowered through a narrow passageway of the tubular member, and which extends in a substantially perpendicular relationship to said longitudinal axis of the housing when the apparatus is in a deployed position.

18. An apparatus for severing tubular members, comprising:

a generally cylindrical housing;

a means for centralizing position of the housing within the tubular member, said centralizing means comprising a plurality of fins hingedly attached to said housing and extending in substantially parallel relationship to a longitudinal axis of the housing while the apparatus is being lowered through a narrow passageway of the tubular member and which extends in a substantially perpendicular relationship to the longitudinal axis of the housing when the apparatus is in a deployed position; and an explosive means carried by said housing for explosively severing the tubular member in a target area.

19. The apparatus of claim 18, wherein said housing is formed with a central opening extending through substantially its entire length, and wherein a piston means is positioned within said housing, said piston means adapted for axial sliding movement within said central opening.

20. The apparatus of claim 19, further comprising a means for limiting downward movement of the piston means, said limiting means comprising an extrusion head mounted in a lower part of the central opening, said limiting means comprises an upper portion which sealingly engages an interior wall of the housing and a reduced diameter lower portion which defines an annular space between its exterior surface and the interior wall of the housing.

21. The apparatus of claim 20, wherein a compressible spring means is mounted in said annular space to allow said limiting means to move a discrete distance downwardly when a downward force is applied on said piston means.

22. The apparatus of claim 20, further comprising a collapsible means for receiving an explosive material secured to the lower portion of said extrusion head, said explosive material receiving means comprising a flexible bag which forms a receptacle for the explosive material extruded into the bag.

23. The apparatus of claim 22, further comprising a means for protecting said collapsible bag, said protecting means comprising a generally cylindrical enclosure having an upper end which contacts said lower portion of extrusion head, such that any downward movement of the extrusion head forces the enclosure downward, away from said housing.

24. The apparatus of claim 22, further comprising means for applying a downward force on said piston means to thereby extrude an explosive material contained in said housing into the collapsible bag.

25. The apparatus of claim 24, wherein said means for applying downward force comprises a pressurized fluid which is admitted into said housing above said piston means.

26. The apparatus of claim 23, wherein said enclosure comprises a sidewall hingedly moveable between a first position, in a substantially parallel relationship to a longitudinal axis of the housing, and a second position, in a substantially perpendicular relationship to a said longitudinal axis, such that said sidewall forms at least a part of support for said collapsible bag when the bag is in a deployed condition.

27. A method for severing tubular members below a mud line, comprising the steps of:

removing mud from a target area within said tubular member;

providing an apparatus for severing tubular members which comprises a generally cylindrical housing, a means for centralizing position of the housing within the tubular member, and an explosive means carried by the housing for explosively severing the tubular member in the target area;

lowering the apparatus to the target area;

centralizing position of the housing within the tubular member;

forcing at least a part of the explosive means from said housing into a collapsible flexible means for receiving the explosive material; and delivering a detonating signal to the explosive material, thereby causing severing of the tubular member below the mud line.

28. The method of claim 27, wherein said apparatus further comprises a piston means adapted for axial sliding movement within a central opening of the housing and a means for limiting downward movement of the piston means within the housing.

29. The method of claim 28, wherein said limiting means comprises an extrusion head mounted in a lower part of the central opening, said extrusion head allowing passage of said explosive material from the housing into the means for receiving the explosive material.

30. The method of claim 29, wherein a downward movement of said piston means causes extrusion of said explosive material into said explosive material receiving means, said explosive material receiving means expanding to form a receptacle for the extruded material.

31. The method of claim 27, wherein said means for centralizing position of the housing within the tubular member comprises a plurality of fins which extend in a substantially parallel relationship to a longitudinal axis of the housing while the apparatus is lowered through a narrow passageway of the tubular member, and which hinge into a substantially perpendicular relationship to the longitudinal axis of the housing when the apparatus is deployed in the target area.

32. The method claim 27, further comprising means for applying a downward force on said piston means, said means for applying the downward force comprising a pressurized fluid admitted into said housing above the piston means.

33. The method of claim 29, wherein said apparatus further comprises a protecting means for protecting the means for receiving the explosive material, said protecting means comprising a generally cylindrical enclosure having an upper end which contacts a lower portion of the extrusion head, such that any downward movement of the extrusion head forces the enclosure away from said housing, said enclosure having a sidewall which hingedly moves between a first position, in a substantially parallel relationship to a longitudinal axis of the housing while the apparatus is being lowered to a target area, and a second position, substantially perpendicular to the longitudinal axis of the housing when the apparatus is in a deployed position.

* * * * *